US008270554B2

(12) United States Patent
Meikrantz et al.

(10) Patent No.: US 8,270,554 B2
(45) Date of Patent: Sep. 18, 2012

(54) METHODS OF PRODUCING CESIUM-131

(75) Inventors: David H. Meikrantz, Idaho Falls, ID (US); John R. Snyder, Idaho Falls, ID (US)

(73) Assignee: The United States of America, as represented by the United States Department of Energy, Washington, DC (US)

( * ) Notice: Subject to any disclaimer, the term of this patent is extended or adjusted under 35 U.S.C. 154(b) by 544 days.

(21) Appl. No.: 12/468,679

(22) Filed: May 19, 2009

(65) Prior Publication Data

US 2010/0296616 A1 Nov. 25, 2010

(51) Int. Cl.
*G21G 1/06* (2006.01)

(52) U.S. Cl. ..... 376/189; 376/158; 376/156

(58) Field of Classification Search ..... 376/158, 376/185, 156, 189
See application file for complete search history.

(56) References Cited

U.S. PATENT DOCUMENTS

| | | | |
|---|---|---|---|
| 4,749,518 | A | 6/1988 | Davis, Jr. et al. |
| 4,959,158 | A | 9/1990 | Meikrantz |
| 5,100,585 | A | 3/1992 | Horwitz et al. |
| 5,344,623 | A | 9/1994 | Horwitz et al. |
| 5,346,618 | A | 9/1994 | Horwitz et al. |
| 5,393,892 | A | 2/1995 | Krakowiak et al. |
| 5,443,731 | A | 8/1995 | Moyer et al. |
| 5,478,953 | A | 12/1995 | Gula et al. |
| 5,571,070 | A | 11/1996 | Meikrantz et al. |
| 5,591,340 | A | 1/1997 | Meikrantz et al. |
| 5,607,591 | A | 3/1997 | Dozol et al. |
| 5,666,641 | A | 9/1997 | Abney et al. |
| 5,666,642 | A | 9/1997 | Hawthorne et al. |
| 5,698,169 | A | 12/1997 | Hawthorne et al. |
| 5,866,087 | A | 2/1999 | Dozol et al. |
| 5,888,398 | A | 3/1999 | Dietz et al. |
| 5,926,687 | A | 7/1999 | Dozol et al. |
| 6,040,462 | A | 3/2000 | Oh et al. |
| 6,066,302 | A | 5/2000 | Bray |

(Continued)

FOREIGN PATENT DOCUMENTS

SU 1706661 9/1991

(Continued)

OTHER PUBLICATIONS

Malinin et al., Production of Cs-131 Without a Carrier and Estimation of the Cross Section of the Cs-131(n, gamma) Cs-132 on Thermal Neutrons, Radiokihimiya, vol. 14, No. 6, pp. 866-869, Nov.-Dec. 1972.*

(Continued)

*Primary Examiner* — Ricardo Palabrica
(74) *Attorney, Agent, or Firm* — Mark C. Lang; Michael J. Dobbs; John T. Lucas

(57) ABSTRACT

Methods of producing cesium-131. The method comprises dissolving at least one non-irradiated barium source in water or a nitric acid solution to produce a barium target solution. The barium target solution is irradiated with neutron radiation to produce cesium-131, which is removed from the barium target solution. The cesium-131 is complexed with a calixarene compound to separate the cesium-131 from the barium target solution. A liquid:liquid extraction device or extraction column is used to separate the cesium-131 from the barium target solution.

19 Claims, 4 Drawing Sheets

U.S. PATENT DOCUMENTS

| | | | | |
|---|---|---|---|---|
| 6,093,375 | A | 7/2000 | Taylor et al. | |
| 6,156,282 | A | 12/2000 | Dozol et al. | |
| 6,174,503 | B1 * | 1/2001 | Moyer et al. | 423/181 |
| 6,214,234 | B1 | 4/2001 | Harjula et al. | |
| 6,258,333 | B1 | 7/2001 | Romanovskiy et al. | |
| 6,270,737 | B1 | 8/2001 | Zaitsev et al. | |
| 6,306,355 | B1 | 10/2001 | Delmau et al. | |
| 6,312,653 | B1 | 11/2001 | Delmau et al. | |
| 6,456,680 | B1 * | 9/2002 | Abalin et al. | 376/189 |
| 6,468,445 | B2 | 10/2002 | Romanovskiy et al. | |
| 6,511,603 | B1 | 1/2003 | Dietz et al. | |
| 6,566,561 | B1 | 5/2003 | Bonnesen et al. | |
| 6,630,114 | B1 | 10/2003 | Dozol et al. | |
| 6,709,642 | B1 | 3/2004 | Dozol et al. | |
| 6,896,716 | B1 | 5/2005 | Jones, Jr. | |
| 7,200,198 | B2 | 4/2007 | Wieland et al. | |
| 7,291,316 | B2 | 11/2007 | Meikrantz et al. | |
| 7,479,261 | B2 | 1/2009 | Bray et al. | |
| 7,524,469 | B2 * | 4/2009 | Meikrantz et al. | 423/8 |
| 2001/0033814 | A1 | 10/2001 | Romanovskiy et al. | |
| 2002/0094056 | A1 * | 7/2002 | Satz et al. | 376/215 |
| 2007/0212285 | A1 * | 9/2007 | Egorov et al. | 423/2 |

FOREIGN PATENT DOCUMENTS

| | | |
|---|---|---|
| WO | 2006012153 | 2/2006 |
| WO | 2006038958 | 4/2006 |
| WO | 2007100799 | 9/2007 |

OTHER PUBLICATIONS

Albright et al., "Neptunium 237 and Americium: World Inventories and Proliferation Concerns," Jun. 10, 2005, pp. 1-19.

Albright et al., "Troubles Tomorrow? Separated Neptunium 237 and Americium," Institute for Science and International Security, 1999, pp. 85-96.

Miotla, Dennis, "Assessment of Plutonium-238 Production Alternatives," Briefing for Nuclear Energy Advisory Committee, Apr. 21, 2008, pp. 1-17.

Todd et al., "Plutonium-238 Recovery From Irradiated Neptunium Targets Using Solvent Extraction," 15th Pacific Basin Nuclear Conference, Oct. 2006, 7 pages.

Bonnesen et al., "Alkaline-Side Extraction of Cesium from Savannah River Tank Waste Using a Calixarene-Crown Ether Extractant," ORNL/TM-13704, Oak Ridge National Laboratory: Oak ridge, TN, pp. ii-102 (Dec. 1998).

Bonnesen et al., "Development of Process Chemistry for the Removal of Cesium from Acidic Nuclear Waste by Calix[4]arene-crown-6 Ethers," ACS Sym. Ser. 757 (Calixarenes for Separations), Am. Chem. Soc., pp. 26-44 (2000).

Bonnesen et al., "A robust alkaline-side CSEX solvent suitable for removing cesium from Savannah River high level waste," Solvent Extr. Ion Exch. 2000, 18(6) 1079-1107.

Bonnesen et al., "Development of effective solvent modifiers for the solvent extraction of cesium from alkaline high-level tank waste," Solvent Extr. Ion Exch. 2003, 21(2) 141-170.

Casnati, et al., "Synthesis, Complexation, and Membrane Transport Studies of 1,3-Alternate Calix[4]arene-crown-6 Conformers: A New Class of Cesium Selective Ionophores," J. Am. Chem. Soc. 117:2767-2777 (1995).

Chiarizia et al., "Composition of the Organic Phase Species in the Synergistic Extraction of Sr2+ by Mixtures of Di(2- Ethylhexyl) Alkylenediphosphonic Acids and Dicyclohexano-18-crown-6," Solvent Extr. and Ion Exch., 21(2):171-197 (2003).

Delmau et al., "Combined Extraction of Cesium and Strontium from Alkaline Nitrate Solutions," Solvent Ext. Ion Exch. 24:197-217 (2006).

Dietz et al., "Extraction of Strontium from Acidic Nitrate Media Using a Modified PUREX Solvent," Solvent Extr. and Ion Exch., 13(1), 1-17 (1995).

Dietz et al., "Substituent Effects in the Extraction of Cesium from Acidic Nitrate Media With Macrocyclic Polyethers," Solvent Extr. and Ion Exch., 14(3), 357-384 (1996).

Dozol et al., "A Solution for Cesium Removal from High-Salinity Acidic or Alkaline Liquid Waste: The Crown Calix[4] Arenes," Sep. Sci. and Technol., 34(6&7):877-909 (1999).

Dozol et al., "Extraction of rubidium and caesium from strongly alkaline media," Radiochim. Acta 92:175-182 (2004).

Duchemin et al., "Solvatochromic Solvent Polarity Measurements of Alcohol Solvent Modifiers and Correlation with Cesium Extraction Strength," Solvent Extr. and Ion Exch., 19(6):1037-1058 (2001).

Gupta, et al., "Effect of Diluents on the Extraction of Sr2+ from HNO3 Solutions with Dicyclohexano-18-crown-6," Solvent Extr. and Ion Exch., 21(1), 53-71 (2003).

Herbst et al., "Development and Testing of a Cobalt Dicarbollide Based Solvent Extraction Process for the Separation of Cesium and Strontium from Acidic Tank Waste," Sep. Sci. and Technol., 37(8), 1807-1831 (2002).

Horwitz et al., "A Combined Cesium-Strontium Extraction/Recovery Process," International Solvent Extraction Committee '96, pp. 1285-1290 (1996).

Horwitz et al., "SREX: A New Process for the Extraction and Recovery of Strontium From Acidic Nuclear Waste Streams," Solvent Extr. and Ion Exch., 9(1):1-25 (1991).

Kyba et al., "Host-Guest Complexation. 1. Concept and Illustration," J. Am. Chem. Soc. 99:8:2564-2571 (1977).

Lamb et al., "Novel Solvent System for Metal Ion Separation: Improved Solvent Extraction of Strontium(II) and Lead (II) as Dicyclohexano-18-crown-6 Complexes," Sep. Sci. and Technol., 34(13):2583-2599 (1999).

Leonard et al., "Development of a Solvent Extraction Process for Cesium Removal From SRS Tank Waste," Sep. Sci. and Technol., 36(5-6):743-766 (2001).

Leonard et al., "Experimental Verification of Caustic-Side Solvent Extraction for Removal of Cesium from Tank Waste," Solvent Extr. and Ion Exch. 21(4) :505-526 (2003).

Moyer et al., "Complexation of Strontium in the Synergistic Extraction System Dicyclohexano-18-Crown-6, Versatic Acid, Carbon Tetrachloride," Solvent Ext. and Ion Exch., 4(1), 83-93 (1986).

Moyer et al., "Caustic-side solvent extraction chemical and physical properties: Progress in FY 2000 and FY 2001," Report ORNL/TM-2001/285, Oak Ridge National Laboratory: Oak Ridge, TN, Feb. 2002.

Norato et al., "Demonstration of the Caustic-Side Solvent Extraction Process for the Removal of 137 Cs from Savannah River Site High Level Waste," Sep. Sci. and Technol., 38(12-13):2647-2666 (2003).

Ouchi et al., "Convenient and Efficient Tosylation of Oligoethylene Glycols and the Related Alcohols in Tetrahydrofuran-Water in the Presence of Sodium Hydroxide," Bull. Chem. Soc. Jpn., 63(4), 1260-1262 (1990).

Sachleben et al., "Surveying the Extraction of Cesium Nitrate by 1,3-Alternate Calix[4]Arene Crown-6 Ethers in 1,2-Dichloroethane," Solvent Ext. and Ion Exch., 17(6), 1445-1459 (1999).

Sachleben et al., "Rational Design of Cesium-Selective Ionophores: Dihydrocalix[4]arene Crown-6 Ethers," Eur. J. Org. Chem. 4862-4869 (2003).

Shehata, F.A., "Extraction of Strontium from Nitric Acid Solutions by Selected Crown Ethers," J. of Radioanalytical and Nuclear Chem., Articles, 185(2) 411-417 (1994).

Tanigawa et al., "Solvent Extraction of Alkali Metals by Crown Ethers," Chem. Eng. J, 39:157-168 (1988).

White et al., "Stability Study of Cs Extraction Solvent," Sep. Sci. and Technol., 38(12-13):2667-2683 (2003).

Wood et al., "Effect of the Interference of Alkali and Alkaline Earth Metal Ions on the Extraction of 90SR From Acidic Nuclear Waste Solutions by 18-crown-6 Derivatives," Solvent Ext. and Ion Exch., 13(5), 829-844 (1995).

Wood et al., "Extraction of Lead and Strontium from Hazardous Waste Streams by Solvent Extraction with 4',4',(5')-DI-(T-Butyldicyclohexo)-18-crown-6," Solvent Ext. and Ion Exch., 15(1), 65-78 (1997).

Zirnhelt et al., "Strontium Extraction with a Polymer-Bound 18-Crown-6 Polyether," Sep. Sci. and Technol., 28 (15&16):2419-2429 (1993).

Peterman et al., Extractant Compositions for Co Extracting Cesium and Strontium, a Method of Separating Cesium and Strontium From an Aqueous Feed, Calixarene Compounds, and an Alcohol Modifier, U.S. Appl. No. 12/268,189, filed Nov. 10, 2008.

Coppinger et al., Advantages of Palmolive Alternate, Programming Operation Hanford Laboratories Operation, Hanford Atomic Products Operation, Richland, Washington.

Tranter et al., An Inorganic Microsphere Composite for the Selective Removal of Cesium from Acidic Nuclear Waste Solutions. 2: Bengh-Scale Column Experiments modeling, and Preliminary Process Design, Solvent Extraction and Ion Exchange, vol. 27, pp. 219-243, 2009.

Dietz et al., Separation and Preconcentration of Cesium from acidic Media by Extraction Chromatography, Separation Science and Technology, vol. 41, pp. 2183-2204, 2006.

Bazelaire et al., pH-Switchable Cesium Nitrate Extraction with Calix[4]arene Mono and bis(Benzo-crown-6) Ethers Bearing Amino Functionalities, Solvent Extraction and Ion Exchange, vol. 22, No. 4, pp. 637-661, 2004.

* cited by examiner

METHODS OF PRODUCING CESIUM-131

The United States Government has certain rights in this invention pursuant to Contract No. DE-AC07-05-ID14517 between the United States Department of Energy and Battelle Energy Alliance, LLC.

CROSS-REFERENCE TO RELATED APPLICATION

This application is related to co-pending U.S. patent application Ser. No. 12/770,178 to Meikrantz et al., entitled "METHODS OF PRODUCING AND RECOVERING PLUTONIUM-238," filed on Apr. 29, 2010.

TECHNICAL FIELD

The invention, in various embodiments, relates generally to methods of producing and recovering radioisotopes. More specifically, the invention, in various embodiments, relates to methods of producing cesium-131 ("$^{131}$Cs" ) from a barium source.

BACKGROUND

In the medical field, various radioisotopes such as $^{131}$Cs, iodine-125, and palladium-103 are used for diagnostics and for treating various forms of cancer. For instance, $^{131}$Cs has been investigated for use in cancer research and treatments, such as in brachytherapy.

$^{131}$Cs is a beta emitter and is produced by radioactive decay from neutron irradiated, naturally occurring barium-130 ("$^{130}$Ba"). When irradiated, $^{130}$Ba captures a neutron, becoming $^{131}$Ba, which decays to $^{131}$Cs with an 11.5 day half-life. $^{131}$Cs decays to xenon-130 with a 9.7 day half-life. However, upon continued exposure to neutrons, $^{131}$Cs is converted to cesium-132 ("$^{132}$Cs") which is a gamma emitter.

To be effective in treating cancers, the $^{131}$Cs should be substantially pure, such as greater than approximately 99.9% $^{131}$Cs. For instance, the $^{131}$Cs should include substantially no impurities, such as $^{130}$Ba, $^{131}$Ba, or $^{132}$Cs. Conventional processes for producing $^{131}$Cs are time consuming, costly, and inefficient. As described in U.S. Pat. No. 7,479,261 to Bray et al., solid barium carbonate is irradiated in a nuclear reactor to produce a barium target. The irradiated barium carbonate target is removed from the nuclear reactor after 7-21 days to limit the formation of undesirable by-products, such as $^{132}$Cs. The irradiated barium carbonate target is stored for several days to limit exposure of personnel to the radiation, and then is dissolved in nitric acid to form a solution of cesium nitrate, barium nitrate, water, and carbon dioxide. The solution is concentrated to remove excess water, additional nitric acid is added, and the solution is dried to near dryness. The solution includes cesium nitrate, which is soluble in the nitric acid, and barium nitrate, which is insoluble in the nitric acid. The barium nitrate remaining in the solution is removed by precipitation. The cesium nitrate is separated from the barium nitrate by filtration or centrifugation. After removing the $^{131}$Cs and unwanted $^{132}$Cs, the irradiated barium carbonate target is stored to enable pure $^{131}$Cs to grow in. The process described above is then repeated periodically to recover the additional $^{131}$Cs. As such, multiple acts, which are time consuming and costly, are utilized in this process for producing and recovering the $^{131}$Cs from the irradiated barium carbonate target. In addition, the 9.7 day half-life of $^{131}$Cs provides significant decay loss of product in this multiple step process.

It would be desirable to produce and recover $^{131}$Cs of a high purity in a process including fewer acts and higher purity. It would also be desirable to eliminate the time, cost, and hazards to personnel associated with using a solid barium target.

SUMMARY OF THE INVENTION

A method of producing $^{131}$Cs is disclosed. The method comprises dissolving at least one non-irradiated barium source in water or a nitric acid solution to produce a barium target solution. The barium target solution is irradiated with neutron radiation to produce $^{131}$Cs, which is removed from the barium target solution.

In another embodiment, the method comprises irradiating a barium target solution comprising at least one non-irradiated barium-130 compound to produce $^{131}$Cs. The $^{131}$Cs is complexed with a calixarene compound and the $^{131}$Cs is separated from the $^{130}$Ba compound.

In another embodiment, the method comprises irradiating a barium target solution to produce an irradiated barium target solution. After barium in the irradiated barium target solution decays for an amount of time sufficient to produce $^{131}$Cs, the $^{131}$Cs is continuously separated from the irradiated barium target solution.

In another embodiment, the method comprises dissolving at least one non-irradiated barium source in an aqueous solution to produce a barium target solution. The barium target solution is irradiated in a nuclear reactor to produce $^{131}$Cs. The irradiated barium target solution is flowed through at least one separation device to remove the $^{131}$Cs.

BRIEF DESCRIPTION OF THE DRAWINGS

While the specification concludes with claims particularly pointing out and distinctly claiming that which is regarded as the present invention, advantages of this invention may be more readily ascertained from the following description of the invention when read in conjunction with the accompanying drawings in which:

DETAILED DESCRIPTION

Figure 1:
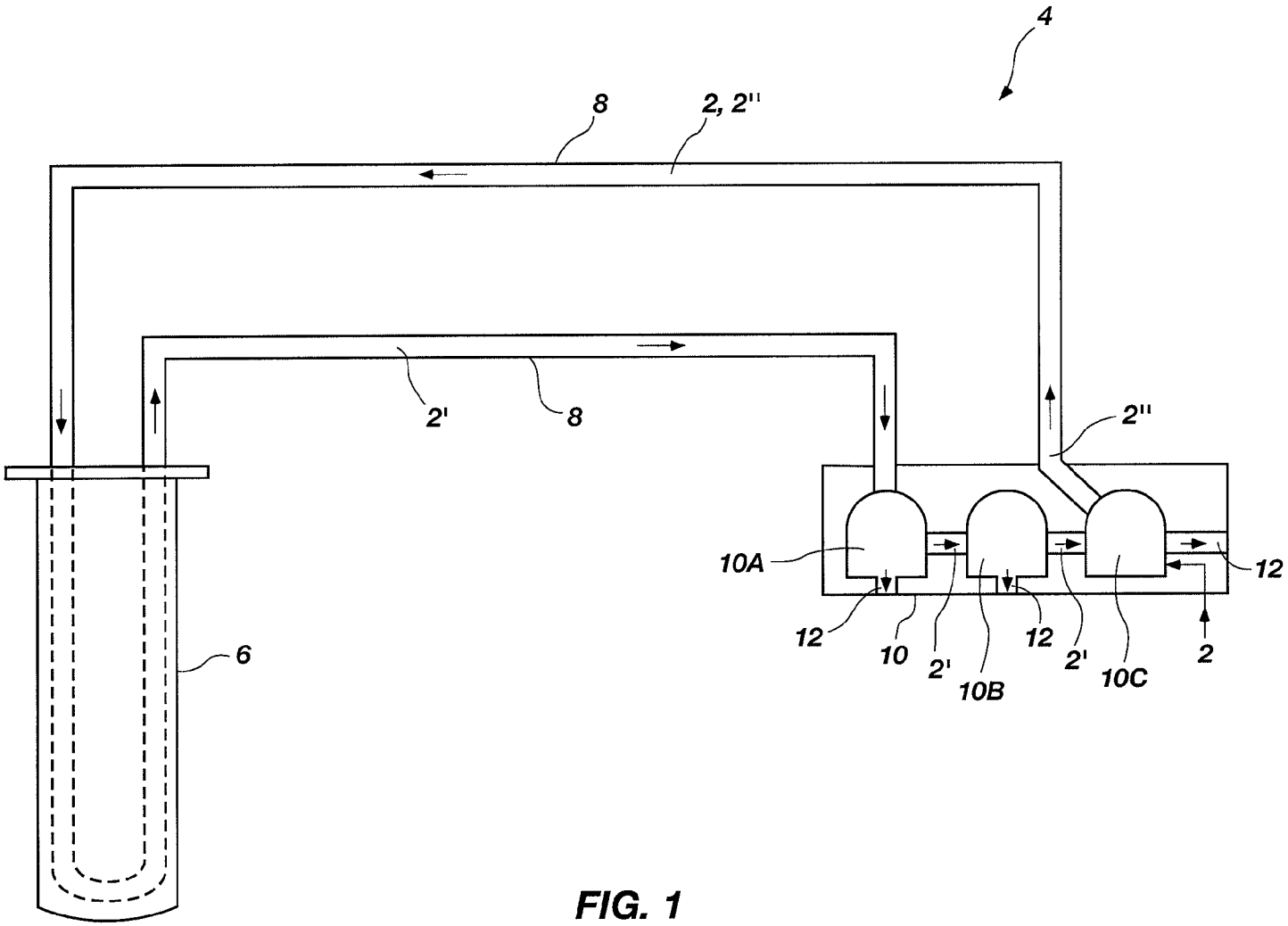
FIGS. 1 and 2 are schematic illustrations of isotope production systems and methods of producing and recovering $^{131}$Cs according to embodiments of the invention.

A method of producing and recovering $^{131}$Cs is disclosed. The $^{131}$Cs is recovered in the form of a $^{131}$Cs ion, such as $Cs^{1+}$. The $^{131}$Cs is produced by neutron decay from a barium source. The barium source is dissolved, before being exposed to neutron irradiation, to produce a barium target solution containing the barium source. The barium target solution is circulated through a neutron field and irradiated to produce $^{131}$Ba, which decays to $^{131}$Cs. The $^{131}$Cs is selectively removed from the irradiated barium target solution using a calixarene compound and recovered, providing the $^{131}$Cs of high purity. The method utilizes fewer separation or purification acts than conventional processes for producing the $^{131}$Cs. The method also eliminates the time and cost associated with preparation of a solid barium target. In addition, the resulting $^{131}$Cs has a higher purity than that produced by conventional techniques.

The barium source may be a compound of naturally occurring barium or may be a compound enriched in $^{130}$Ba, such as a barium compound or combination of barium compounds. As used herein, the term "naturally occurring barium" means and includes barium including a mixture of seven stable barium isotopes: $^{130}$Ba (0.1%), $^{132}$Ba (0.1%), $^{134}$Ba (2.4%), $^{135}$Ba (6.6%), $^{136}$Ba (7.9%), $^{137}$Ba (11.2%), and $^{138}$Ba (71.7%). The natural abundance of each of the barium isotopes is indicated in parenthesis. The term "enriched barium" means and includes barium having an abundance of $^{130}$Ba that is greater than 0.1%. By way of non-limiting example, the enriched barium may include from 0.2% to 50% $^{130}$Ba, such as from 30% to 50% $^{130}$Ba. The barium source may be a high purity, barium salt or other barium compound that is substantially soluble in water or a nitric acid solution. The barium source may include, but is not limited to, barium carbonate ($BaCO_3$), barium chlorate ($Ba(ClO_3)_2.H_2O$), barium chloride ($BaCl_2$), barium formate ($Ba(CHO_2)_2$), barium fluoride ($BaF_2$), barium nitrate ($Ba(NO_3)_2$), barium metal, barium oxide (BaO), or combinations thereof. Natural barium compounds suitable for use as the barium source are commercially available from various sources, such as Sigma-Aldrich Co. (St. Louis, Mo.), Trace Sciences International (Wilmington, Del.), or other chemical suppliers. The barium source may have a purity of greater than approximately 95%, such as approximately 100%. Such barium compounds are inexpensive relative to the cost of enriched barium targets used in conventional processes.

The barium source may be dissolved in water or a nitric acid solution to form a barium target solution. The barium source dissolved in the barium target solution may be non-irradiated. The term "non-irradiated" is used herein to mean and include a barium source that has not been exposed to neutron radiation. Rather, the barium source is a compound of naturally occurring barium or enriched barium. The barium target solution may include a minimum barium concentration of approximately 0.5 M barium. The maximum concentration of barium in the barium target solution may be the solubility limit of the barium source in the water or nitric acid solution. By way of non-limiting example, the barium target solution may include from approximately 0.5 M to approximately 1 M of the barium source. The nitric acid solution used in the barium target solution may be an aqueous solution having a nitric acid concentration of from approximately 1 M to approximately 3 M.

Figure 2:
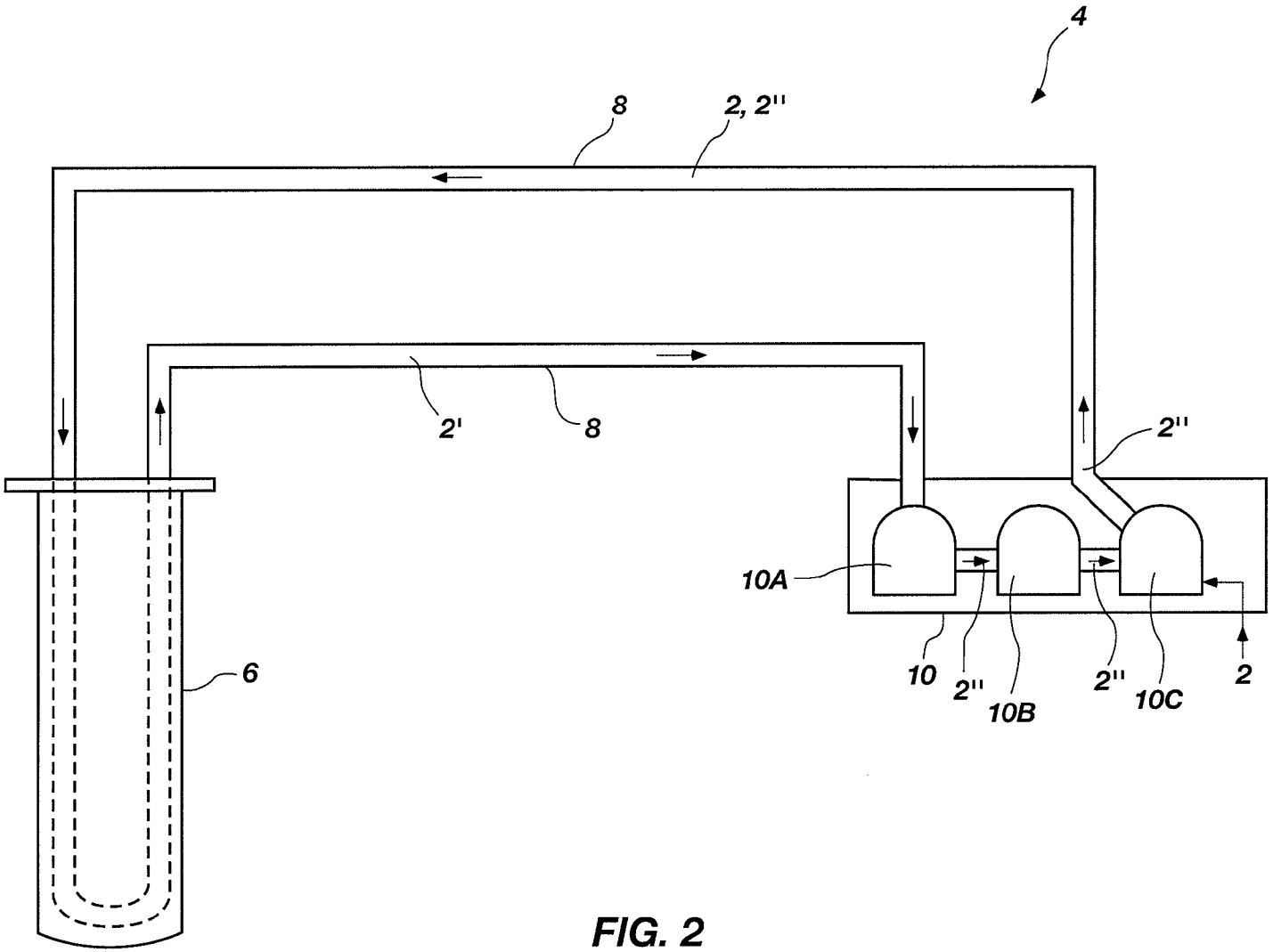

After dissolving the barium source in the water or nitric acid solution, the barium target solution may be subjected to neutron radiation. To irradiate the barium source, the barium target solution 2 may be introduced into an isotope production system 4, as shown in FIGS. 1 and 2. In one embodiment, shown in FIG. 1, the isotope production system 4 includes an inlet (not shown) through which the barium target solution 2 is introduced, a neutron source 6, a liquid loop 8, a separator 10, and an outlet (not shown) through which a $^{131}$Cs solution 12 exits the isotope production system 4. In another embodiment, shown in FIG. 2, the isotope production system 4 includes the barium target solution 2, the neutron source 6, the liquid loop 8, and the separator 10. In the embodiment of FIG. 2, the $^{131}$Cs is recovered from the separator 10 as described in more detail below. As used herein, the term "liquid loop" means and includes means for transporting or circulating the barium target solution 2, irradiated barium target solution 2', or extracted barium target solution 2" throughout the isotope production system 4. The structure of the liquid loop 8 may be formed from a material that is capable of containing the barium target solution 2, irradiated barium target solution 2', and extracted barium target solution 2", and is substantially non-reactive with the components of the barium target solution 2, irradiated barium target solution 2', and extracted barium target solution 2". By way of non-limiting example, components of the liquid loop 8 may be formed from stainless steel, aluminum, zirconium, or other corrosion-resistant, neutron-transparent alloy or material. To assist in circulating the barium target solution 2, irradiated barium target solution 2', and extracted barium target solution 2", the isotope production system 4 may include additional features, such as a pump. The pump may be a conventional device that is capable of transporting the barium target solution 2, irradiated barium target solution 2', and extracted barium target solution 2" through the liquid loop 8 and neutron source 6. The pump may also circulate the irradiated barium target solution 2' to the separator 10. The pump may be formed from a material compatible with the barium target solution 2, irradiated barium target solution 2', and extracted barium target solution 2". The isotope production system 4 may also include a heat exchanger if heating or cooling of the barium target solution 2, irradiated barium target solution 2', or extracted barium target solution 2" is desired. The heat exchanger, if present, may be a conventional device that transfers heat away from the barium target solution 2, irradiated barium target solution 2', or extracted barium target solution 2". The isotope production system 4 may also include openings, such as vents, to enable offgasing of byproducts. These additional features of the isotope production system 4 are not shown in FIG. 1 for simplicity and clarity.

The barium target solution 2 and extracted barium target solution 2" may be subjected to neutron irradiation by continuously flowing the barium target solution 2 or extracted barium target solution 2" through the neutron source 6. The neutron source 6 may be a device capable of producing thermal neutron irradiation, such as a nuclear reactor. The nuclear reactor may be a conventional nuclear reactor capable of producing neutrons and continuously irradiating the barium target solution 2 or the extracted barium target solution 2" with the neutrons. By way of non-limiting example, the nuclear reactor may be a pool-type reactor including, but not limited to, a TRIGA® reactor. Since the neutron source 6 is conventional, specific details of its design and configuration are not described or illustrated herein. As the barium target solution 2 or extracted barium target solution 2" flows through the isotope production system 4, a portion of the barium target solution 2 or extracted barium target solution 2" may enter the neutron source 6 and be irradiated with neutrons, forming the irradiated barium target solution 2'. Since the barium target solution 2 or extracted barium target solution 2" circulates throughout the isotope production system 4, the entire volume of the barium target solution 2 or extracted barium target solution 2" may, over time, be irradiated with neutrons. Even though only a portion of the barium target solution 2 or extracted barium target solution 2" passes through the neutron source 6 at a given time, for simplicity, the process is described herein as applying to the barium target solution 2 or extracted barium target solution 2", rather than a portion of the barium target solution 2 or extracted barium target solution 2". As the barium target solution 2 or extracted barium target solution 2" passes through the neutron source 6, the barium target solution 2 or extracted barium target solution 2" may be exposed to radiation of a sufficient energy for the $^{130}$Ba to capture neutrons, forming $^{131}$Ba, which decays to $^{131}$Cs. The energy conditions utilized for irradiating the barium target solution 2 or extracted barium target solution 2" are conventional and, therefore, are not described in detail herein. By way of non-limiting example, the barium target solution 2 or extracted barium target solution 2" may be exposed to thermal neutrons having a mean energy of approximately 0.025 eV and a velocity of approximately 2200 m/s.

Once irradiated, the irradiated barium target solution 2' may be circulated by way of the liquid loop 8 to the separator 10 of the isotope production system 4. Since the irradiated barium target solution 2' is not manually transported from the neutron source 6, such as for separation and purification of the $^{131}$Cs, exposure of personnel to radiation is greatly reduced in comparison to conventional techniques for producing $^{131}$Cs. The irradiated barium target solution 2' may include $^{131m}$Ba and $^{131}$Ba, or $^{131m}$Ba, $^{131}$Ba, and $^{131}$Cs depending on the amount of time that has elapsed since the irradiation of the barium target solution 2. After a sufficient amount of time has elapsed, the $^{130}$Ba in the irradiated barium target solution 2' may be converted to $^{131}$Ba, which subsequently decays to $^{131}$Cs with a half-life of 11.5 days. The rate of production of the $^{131}$Ba may depend on the initial concentration of $^{130}$Ba in the barium target solution 2, the neutron fluence, the neutron capture cross section of the $^{130}$Ba, and the irradiation time. For instance, immediately before irradiation of a fresh volume of the barium target solution 2, no radioactivity may be present in the barium target solution 2. However, after the irradiation, the radioactivity in the irradiated barium target solution 2' may be substantially due to $^{131m}$Ba and $^{131}$Ba. In addition, trace amounts of other radioisotopes may be present. As the $^{131}$Ba decays, $^{131}$Cs may begin to appear in the irradiated barium target solution 2'. As such, the irradiated barium target solution 2' may include the radioactive isotopes $^{131}$Ba, $^{131m}$Ba, and $^{131}$Cs before the $^{131}$Cs is selectively removed in the separator 10.

As the $^{131}$Cs begins to accumulate, the $^{131}$Cs may be continuously removed from the irradiated barium target solution 2' using the separator 10. The separator 10 may include at least one separation device 10A that utilizes a calixarene compound to selectively remove the $^{131}$Cs while the $^{131}$Ba remains in the irradiated barium target solution 2'. The $^{131}$Cs is removed relative to the $^{131}$Ba, which is also present in the irradiated barium target solution 2'. The calixarene compound may form a complex with the $^{131}$Cs, enabling its selective removal from the irradiated barium target solution 2'. Since the $^{131}$Cs in the irradiated barium target solution 2' has a valence state of +1 and the $^{130}$Ba and $^{131}$Ba have a valence state of +2, the $^{131}$Cs may coordinate or complex with the calixarene compound, while the $^{130}$Ba and $^{131}$Ba do not coordinate or complex with the calixarene compound.

The separation device 10A may be a device capable of conducting a liquid:liquid extraction using the calixarene compound as an extractant, as shown in FIG. 1, or an extraction chromatography device capable of using the calixarene compound as a stationary phase, as shown in FIG. 2. By way of non-limiting example, the separation devices 10A, 10B, 10C may be liquid:liquid extraction devices, such as centrifugal separators or annular centrifugal contactors ("ACC"). Examples of ACCs include those described in U.S. Pat. Nos. 5,571,070, 5,591,340, and 7,157,061 to Meikrantz et at and U.S. Pat. No. 4,959,158 to Meikrantz, the disclosure of each of which is incorporated by reference herein in its entirety. ACCs are commercially available, such as from Costner Industries Texas LP (Houston, Tex.), and provide a high throughput method of performing the liquid-liquid extraction. The separation devices 10A, 10B, 10C may also be extraction chromatography columns that contains the calixarene compound coated on a solid support. For instance, the calixarene compound may be used as a stationary phase in an extraction chromatography column. In addition, combinations of ACCs and extraction chromatography columns may be used as the separation devices 10A, 10B, 10C. While three separation devices 10A, 10B, 10C are illustrated in FIGS. 1 and 2, the separator 10 may include more than three or less than three separation devices 10A, 10B, 10C depending on the desired purity of the $^{131}$Cs. For instance, the irradiated barium target solution 2' may be flowed through one or two separation devices 10A, 10B. To protect personnel from the radiation emitted by the irradiated barium target solution 2', the separation devices 10A, 10B, 10C may be enclosed in a containment device, such as a glove box and/or shielded cell.

The $^{131}$Cs may be continuously separated from the $^{130}$Ba and $^{131}$Ba by flowing the irradiated barium target solution 2' through the separation devices 10A, 10B, 10C of the separator 10. If the separation devices 10A, 10B, 10C are liquid: liquid extraction devices, such as ACCs, the irradiated barium target solution 2' may be contacted with a calixarene extractant solution that includes the calixarene compound. The components of the calixarene extractant solution are described in detail below. The calixarene extractant solution may function in the liquid:liquid extraction device as an organic phase, while the irradiated barium target solution 2' may function as an aqueous phase. When the irradiated barium target solution 2' and the calixarene extractant solution are contacted and agitated with one another, the $^{131}$Cs may partition into the calixarene extractant solution (organic phase), while the $^{130}$Ba and $^{131}$Ba remain in the irradiated barium target solution 2' (aqueous phase). As such, the $^{131}$Cs is removed or forward extracted from the irradiated barium target solution 2'.

After extracting the $^{131}$Cs, the irradiated barium target solution 2' may be substantially depleted of $^{131}$Cs while the calixarene extractant solution includes substantially all of the $^{131}$Cs. The irradiated barium target solution 2' and the calixarene extractant solution containing the $^{131}$Cs may then be separated from one another by conventional techniques, such as by conventional liquid-liquid separation techniques. Since the calixarene extractant solution includes one predominant isotope, $^{131}$Cs, minimal recovery and purification acts are used to recover the $^{131}$Cs compared to conventional $^{131}$Cs processes. The calixarene extractant solution containing the $^{131}$Cs may be removed from the separation device 10A once sufficient radioactivity has accumulated, and is referred to herein as $^{131}$Cs solution 12. However, to increase the amount of $^{131}$Cs removed from the irradiated barium target solution 2', the irradiated barium target solution 2' from separation device 10A may be passed through separation devices 10B, 10C in which additional liquid:liquid extractions are conducted. The calixarene extractant solution containing the $^{131}$Cs may exit the separation devices 10B, 10C as $^{131}$Cs solution 12 once sufficient radioactivity has accumulated. The $^{131}$Cs solution 12 may be periodically removed from the separation devices 10A, 10B, 10C, such as weekly or monthly. The $^{131}$Cs may be removed from the irradiated barium target solution 2' at a sufficient efficiency to prevent the formation of $^{132}$Cs from $^{131}$Cs. By continuously removing the $^{131}$Cs, the $^{131}$Cs is no longer exposed to neutrons, which substantially prevents the production of $^{132}$Cs. Therefore, continuously removing the $^{131}$Cs from the irradiated barium target solution 2' may maximize the $^{131}$Cs recovery rate.

The irradiated barium target solution 2' including the $^{131}$Cs maybe continuously passed through the liquid:liquid extraction device to continuously remove the $^{131}$Cs as it is produced. The $^{131}$CS may be continuously removed from the-irradiated barium target solution 2' by continuously contacting the irradiated barium target solution 2' with the calixarene extractant solution, enabling the $^{131}$Cs to distribute into the calixarene extractant solution. Once desired levels of $^{131}$Cs are achieved in the separator 10, the $^{131}$Cs solution 12 may be removed from the separator 10 and further purified, if desired. Additional purification of the $^{131}$Cs from the $^{131}$Cs solution 12 may be conducted outside the separator 10, such as by passing the $^{131}$Cs solution 12 through extraction chromatography columns, ion exchange columns, or by filtering the $^{131}$Cs solution 12. The $^{131}$Cs may then be concentrated, such as to dryness, by evaporation.

After the irradiated barium target solution 2' and calixarene extractant solution containing the $^{131}$Cs are separated in the liquid:liquid extraction device, the extracted barium target solution 2", which lacks the $^{131}$Cs, may be circulated through the isotope production system 4 for an amount of time sufficient for any $^{130}$Ba remaining in the extracted barium target solution 2" to be activated to $^{131}$Ba and for additional $^{131}$Cs to grow in. The extracted barium target solution 2" may be flowed through the neutron source 6 and exposed to neutron irradiation, producing the irradiated barium target solution 2'. As the $^{131}$Cs accumulates in the irradiated barium target solution 2' and is continuously removed by the separator 10, as described above, the resulting $^{131}$Cs solution 12 may be removed outside the continuous process system for further purification whenever the radioactive quantity desired is reached. After a sufficient amount of the $^{130}$Ba is depleted from the barium source, additional $^{130}$Ba may be introduced into the isotope production system 4 to produce additional $^{131}$Cs by adding additional barium to the isotope production system 4. By way of non-limiting example, additional $^{130}$Ba, in the form of the natural barium source, may be dissolved into the extracted barium target solution 2" and passed through the isotope production system 4.

The $^{131}$CS solution 12 may be further processed to recover the $^{131}$Cs in the form of a $^{131}$Cs ion. The $^{131}$Cs may be removed or stripped from the $^{131}$Cs solution 12 by adjusting the pH of the calixarene extractant solution with an aqueous acid solution. The aqueous acid solution may be an aqueous nitric acid solution having from approximately 0.001 M $HNO_3$ to approximately 0.5 M $HNO_3$, such as approximately 0.01 M $HNO_3$. The $^{131}$Cs solution 12 and the aqueous acid solution may be contacted and agitated such that the $^{131}$Cs partitions from the $^{131}$Cs solution 12 and into the aqueous acid solution. The $^{131}$Cs solution 12, which is now depleted of $^{131}$Cs, and the aqueous acid solution, which now contains the $^{131}$Cs, may then be separated by conventional liquid: liquid separation techniques. While the $^{131}$Cs solution 12 is being stripped, a fresh volume of the calixarene extractant solution may be contacted with the irradiated barium target solution 2' in the isotope production system 4 to provide a continuous process for recovering the $^{131}$Cs.

The aqueous acid solution containing the $^{131}$Cs may be used or further purified. For instance, the aqueous acid solution containing the $^{131}$Cs may be concentrated, such as to dryness, by evaporating the aqueous acid solution. The resulting $^{131}$Cs may then be used in brachytherapy seeds, which are administered to patients having cancerous tumors. The brachytherapy seeds may be formed by conventional techniques, which are not described in detail herein. To shorten the processing time, the brachytherapy seeds may be produced at the same facility where the $^{131}$Cs is recovered, enhancing the therapeutic value of the $^{131}$Cs brachytherapy seeds, which have a half-life of 9.7 days.

The calixarene extractant solution includes at least one calixarene compound and at least one modifier dissolved in a diluent. The calixarene compound may be a calix[4]arene-crown ether compound, such as a derivative of a calix[4] arene-crown-6 ether including, but not limited to, a mono- or bis-crown-6-derivative of 1,3 calix[4]arene or a dialkyloxy-calix[4]arenebenzo-crown-6 compound. The calixarene compound may be one of the compounds described in U.S. Pat. No. 7,291,316 to Meikrantz et al., or in U.S. patent application Ser. No. 12/268,189 to Peterman et al., filed Nov. 10, 2008, and entitled "Extractant Compositions for Co Extracting Cesium and Strontium, A Method of Separating Cesium and Strontium from An Aqueous Feed, Calixarene Compounds, and An Alcohol Modifier." The disclosure of each of the above-mentioned documents is incorporated by reference herein in its entirety. The calixarene compound may be in cone, partial cone, 1,2 alternate, or 1,3 alternate conformations. The calixarene compound may be present in the calixarene extractant solution from approximately 0.0025 M to approximately 0.025 M.

In one embodiment, the calixarene compound is calix[4] arene-bis-(tert-octylbenzo)-crown-6 ("BOBCalixC6"). BOBCalixC6 is available from IBC Advanced Technologies, Inc. (American Fork, Utah) and has a molecular weight of 1149.52 g/mol, BOBCalixC6 has the following structure:

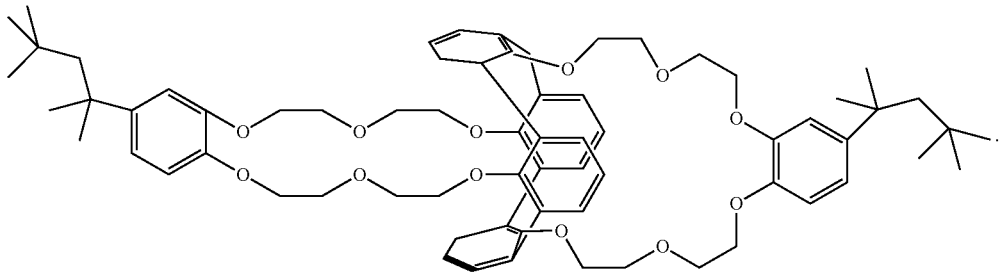

In another embodiment, the calixarene compound is a dialkyloxycalix[4]arenebenzocrown-6 compound having a general chemical structure as shown below:

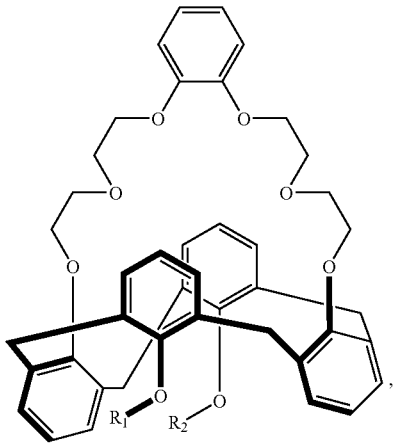

where each of $R_1$ and $R_2$ is an alkyl group and $R_1$ and $R_2$ may be the same or different. The alkyl group may be a saturated, straight, or branched hydrocarbon including from three carbon atoms to fourteen carbon atoms. Examples of the alkyl groups include, but are not limited to, propyl, methylethyl, butyl, methylpropyl, dimethylethyl, pentyl, methylbutyl, dimethylpropyl, trimethylethyl, ethylpropyl, hexyl, methylpentyl, dimethylbutyl, ethyltutyl, trimethylpropyl, heptyl, methylhexyl, dimethylpentyl, ethylpentyl, propylbutyl, trimethylbutyl, octyl, methylheptyl, dimethylhexyl, ethylhexyl, propylpentyl, trimethylpentyl, nonyl, methyloctyl, dimethylheptyl, ethylheptyl, propylhexyl, trimethylhexyl, decyl, methylnonyl, dimethyloctyl, ethyloctyl, propylheptyl, trimethylheptyl, butylhexyl, tetramethylhexyl, undecyl, methyldecyl, dimethylnonyl, ethylnonyl, propyloetyl, trimethyloctyl, butylheptyl, tetramethylheptyl, pentylhexyl, dodecyl, methylundecyl, dimethyldecyl, ethyldecyl, propylnonyl, trimethylnonyl, butyloetyl, tetramethyloctyl, pentylheptyl, tridecyl, methyldodecyl, dimethyl undecyl, ethylundecyl, propyldecyl, trimethyldecyl, butylnonyl, tetramethylnonyl, pentyloctyl, hexylheptyl, tetradecyl, methyltridecyl, dimethyldodecyl, ethyldodecyl, propylundecyl, trimethylundecyl, butyldecyl, pentylnonyl, or hexyloctyl.

Specific examples of dialkyloxycalix[4]arenebenzocrown-6 compounds that may be used in the calixarene extractant solution include, but are not limited to:

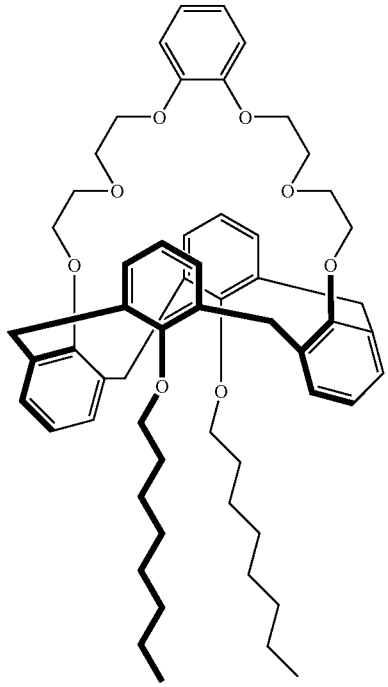

MC-8: 1,3-alternate-25,27-di(octyloxy)calix[4]arenebenzocrown-6,

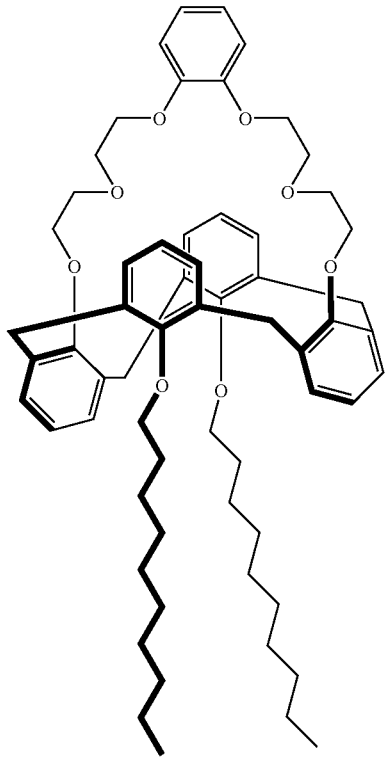

MC-10: 1,3-alternate-25,27-di(decyloxy)calix[4]arenebenzocrown-6,

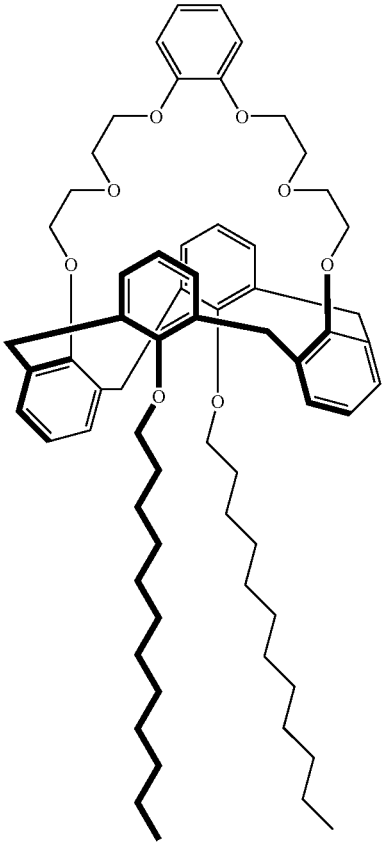

MC-12: 1,3-alternate-25,27-di(dodecyloxy)calix[4]arenebenzocrown-6,

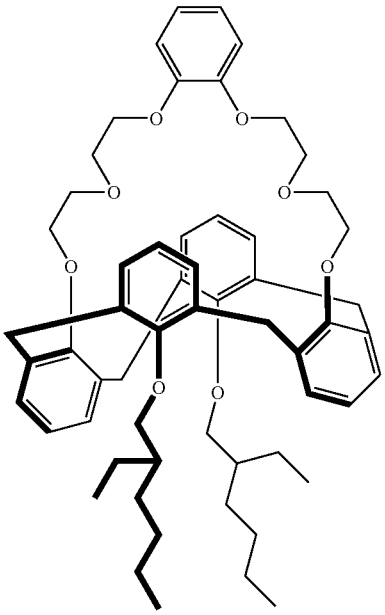

MC-8B: 1,3-alternate-25,27-di(2-ethylhexyl-1-oxy)calix[4]arenebenzocrown-6,

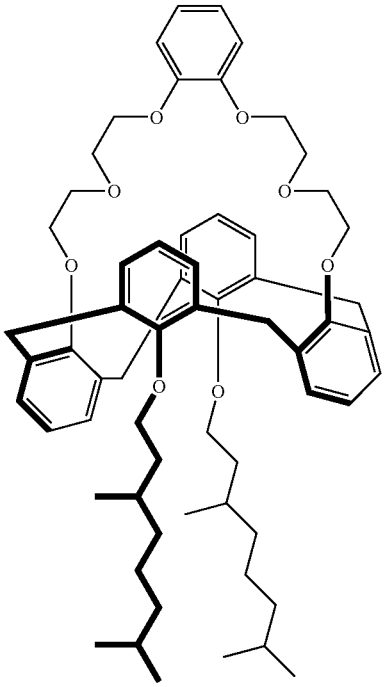

MC-10B: 1,3-alternate-25,27-di(3,7-dimethyloctyl-1-oxy)calix[4]arenebenzocrown-6,

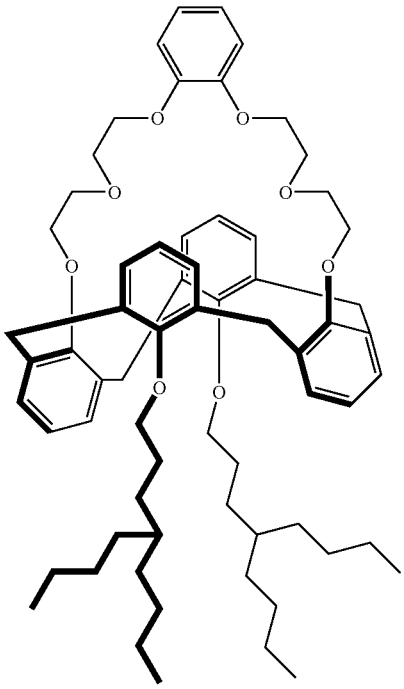

MC-12B: 1,3-alternate-25,27-di(4-butyloctyl-1-oxy)calix[4]arenebenzoerown-6, and combinations thereof Structural isomers or constitutional isomers of MC-8B, MC-10B, and MC-12B may also be used in the calixarene extractant solution, alone or in combination with one or more of the above-mentioned structures. The dialkyloxycalix[4]arenebenzocrown-6 compounds described above may be synthesized as described in the above-mentioned U.S. patent application Ser. No. 12/268,189 to Peterman et al.

The at least one modifier may be an alcohol modifier, trioctylamine ("TOA"), tri-n-butyl phosphate ("TBP"), or combinations thereof The modifier used in the calixarene extractant solution may be one of the modifiers described in the above-mentioned U.S. Pat. No. 7,291,316 to Meikrantz et al., or U.S. patent application Ser. No. 12/268,189 to Peterman et al. In one embodiment, the modifier is 3-[4-(tert-octyl) phenoxy]-1-propanol ("Cs-4"), 3-[4-(sec-butyl)phenoxy]-1-propanol ("Cs-4SB"), 3-[4-(tert-octyl)phenoxy]-2-methyl-1-propanol ("Cs-5"), 3-[4-(sec-butyl)phenoxy]-2-methyl-1-propanol ("Cs-5SB"), or 1-(2,2,3,3-tetrafluoropropoxy)-3-(4-sec-butylphenoxy)-2-propanol ("Cs-7SB"). The modifier may be present in the calixarene extractant solution at from approximately 100 mM to approximately 3.0 M. The modifier may increase the calixarene compound's ability to extract the cesium and may enable a lower concentration of the calixarene compound to be used in the calixarene extractant solution. The modifier may also prevent the formation of a third phase during the extraction. In addition, the modifier may improve stripping efficiency of the cesium, enabling the cesium to be effectively removed or stripped from the calixarene extractant solution. If the calixarene compound is sufficiently soluble in the modifier, the modifier may be used as both a modifier and a diluent.

The diluent may be an inert diluent, such as a straight chain hydrocarbon diluent. For instance, the diluent may be an isoparaffinic hydrocarbon diluent, such as ISOPAR® L or ISOPAR® M. ISOPAR® L includes a mixture of $C_{10}$-$C_{12}$ isoparaffinic hydrocarbons and is available from Exxon Chemical Co. (Houston, TX). ISOPAR® M includes a mixture of $C_{12}$-$C_{15}$ isoparaffinic hydrocarbons and is available from Exxon Chemical Co. (Houston, TX).

The calixarene extractant solution may be prepared by combining the calixarene compound and the modifier with the diluent to form a mixture. Initially, a portion of a final volume of the diluent may be added to the calixarene compound and the modifier to lower the viscosity of the mixture. The mixture may be stirred overnight and the remainder of the diluent may then be added.

As shown in FIG. 2, if the separation devices 10A, 10B, 10C are chromatography devices, such as extraction chromatography columns, the calixarene compound may be coated on a solid support of the chromatography column. The solid support may be silica or an organic polymer. The calixarene compound may be one of the compounds discussed above and may function as a stationary phase of the extraction chromatography column. Extraction chromatography columns and techniques for immobilizing the calixarene compound on the solid support are known in the art and, therefore, are not described in detail herein. As the irradiated barium target solution 2' passes through the extraction chromatography column, the $^{131}$Cs may come into contact with the calixarene compound and form a complex with the calixarene compound. Since the $^{131}$Cs is to be continuously removed, the irradiated barium target solution 2' may be continuously flowed through extraction chromatography columns that function as separation devices 10A, 10B, 10C. The extracted barium target solution 2" that exits the extraction chromatography column is substantially depleted of the $^{131}$Cs. If, however, additional $^{131}$Cs is present, the extracted barium target solution 2" may be flowed through additional extraction chromatography columns as desired.

The extracted barium target solution 2", which lacks the $^{131}$Cs, may be circulated through the isotope production system 4 for an amount of time sufficient for any $^{130}$Ba remaining in the extracted barium target solution 2" to be activated to $^{131}$Ba and for additional $^{131}$Cs to grow. The extracted barium target solution 2" may be flowed through the neutron source 6 and exposed to neutron irradiation, producing the irradiated barium target solution 2'. As the $^{131}$Cs accumulates in the irradiated barium target solution 2' and is passed through the extraction chromatography columns, the $^{131}$Cs complexes with the calixarene compound. The $^{131}$Cs is eluted from the extraction chromatography columns, as described below.

The $^{131}$Cs complexed to the calixarene compound may be eluted from the extraction chromatography column using an aqueous acid solution as a mobile phase. To reduce exposure of personnel to radiation, the extraction chromatography column having the $^{131}$Cs complexed to the calixarene compound may be removed from the separator 10 and transported to a different location for elution of the $^{131}$Cs. For instance, if the separation devices 10A, 10B, 10C are extraction chromatography columns, the extraction chromatography columns may be removed from the isotope production system 4 before eluting the $^{131}$Cs. The aqueous acid solution used to elute the $^{131}$Cs may be an aqueous nitric acid solution having from approximately 0.001 M $HNO_3$ to approximately 6 M $HNO_3$, such as from 0.001 M $HNO_3$ to approximately 0.5 M $HNO_3$. By way of non-limiting example, the aqueous acid solution may have approximately 0.01 M $HNO_3$. The aqueous acid solution exiting the extraction chromatography column may be collected and includes substantially all of the $^{131}$Cs. The aqueous acid solution containing the $^{131}$Cs may be concentrated and taken to dryness, such as by evaporating the aqueous acid solution. The aqueous acid solution containing the $^{131}$Cs may also be farther purified by subjecting the aqueous acid solution to filtration, ion exchange chromatography, extraction chromatography, or other conventional techniques. The resulting $^{131}$Cs may then be used in brachytherapy seeds, as previously described.

Since $^{131}$Cs is the only isotope to be removed by the separation devices 10A, 10B, 10C (liquid:liquid extraction device or extraction chromatography column), $^{131}$Cs having higher purity may be achieved by the method of the invention compared to conventional techniques. By way of non-limiting example, the $^{131}$Cs produced by the method of the invention may be greater than 99.9% pure. In addition, since the $^{131}$ Cs is continuously removed from the irradiated barium target solution 2' before subsequent neutron capture can occur, the resulting $^{131}$Cs is substantially free of $^{132}$Cs. The described method of producing $^{131}$Cs also provides isolating cesium-131 with fewer separation acts.

In addition to selectively removing the $^{131}$Cs from the irradiated barium target solution 2' using calixarene compounds, the $^{131}$Cs may be removed using an inorganic ion exchange composite as described in Tranter et al., *Solvent Extr. and Ion Exch.,* 27:219-243 (2009), the disclosure of which is incorporated by reference herein in its entirety. The inorganic ion exchange composite includes ammonium molybdophosphate synthesized within hollow aluminosilicate microspheres.

The $^{131}$Cs may also be intermittently removed from the isotope production system 4, such as if the isotope production system 4 is taken offline for maintenance. Before restarting the neutron source 6 after the isotope production system 4 has been offline, any $^{131}$Cs that has accumulated in the irradiated barium target solution 2' and extracted barium target solution 2" may be removed, as described above, to prevent the formation of $^{132}$Cs. After removing the $^{131}$Cs, the isotope production system 4 may be put back online.

By utilizing a liquid target of the barium source, the irradiated barium target solution 2' may be continuously circulated through the isotope production system 4 until substantially all of the $^{130}$Ba is depleted and has been converted to the recovered $^{131}$Cs. In contrast, conventional processes of producing $^{131}$Cs use a solid barium target, which leads to incomplete use of available $^{130}$Ba. In addition, since the irradiated barium target solution 2' is a liquid, the irradiated barium target solution 2' may be easily transported between the neutron source 6 and the separator 10 by way of the liquid loop 8, with minimal exposure of personnel to irradiation. The irradiated barium target solution 2' may be circulated through a single system, the isotope production system 4, to achieve both irradiation of the $^{130}$Ba and separation of the $^{131}$Cs. This is in contrast to conventional processes of producing $^{131}$Cs where the barium target is a solid material that is manually loaded into the nuclear reactor for irradiation. The irradiated solid target is then manually removed from the nuclear reactor for isolation and purification of the $^{131}$Cs. However, the loading and unloading of the solid target is time consuming, costly, and exposes personnel to irradiation.

The following example serves to explain embodiments of the present invention in more detail. This example is not to be construed as being exhaustive or exclusive as to the scope of this invention.

EXAMPLE 1

Irradiation of Natural Carbonate

Figure 3:
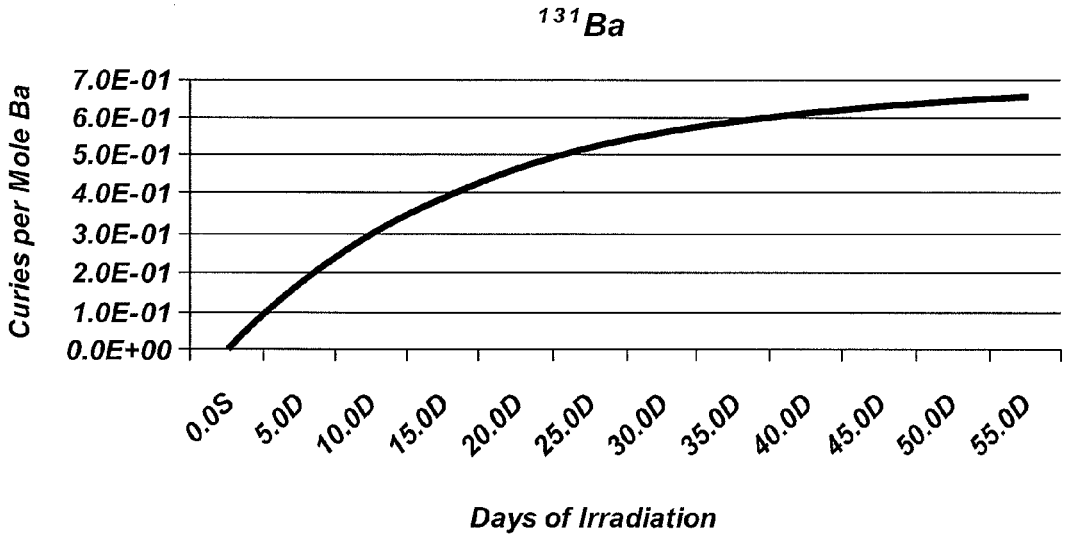
FIGS. 3-5 illustrate the growth of $^{131}$Ba, $^{131}$Cs, and $^{132}$Cs as a function of days of irradiation.
Figure 4:
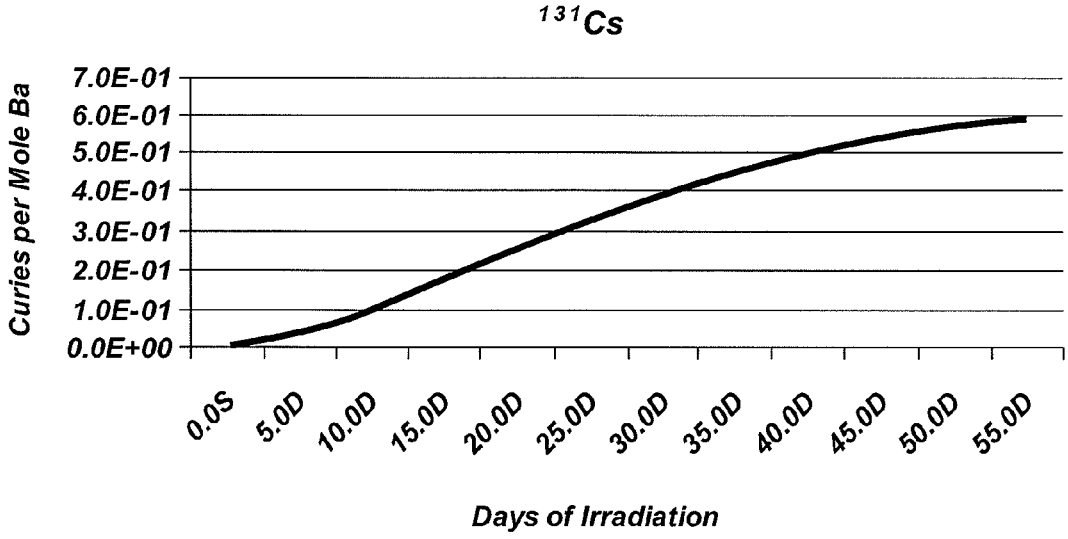
Figure 5:
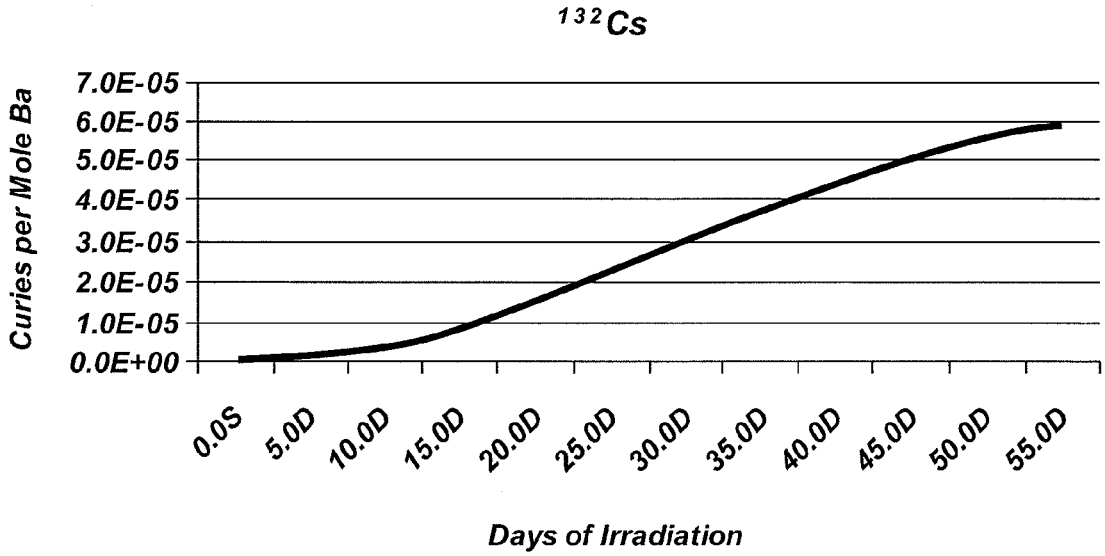

The growth of $^{131}$Ba, $^{131}$Cs, and $^{132}$Cs from 1 mole (137.33 g) of natural barium carbonate irradiated in a neutron flux of $5\times10^{12}$ n/cm$^2$ s for 55 days in 5 day increments was calculated. The natural barium carbonate used was 100% pure. The calculations assumed no removal of $^{132}$Cs from the irradiated material. The $^{131}$Ba, $^{131}$Cs, and $^{132}$Cs growth was calculated using ORIGEN2 version 2.2, a depletion and radioactive decay computer code developed by Oak Ridge National Laboratory. Plots showing the growth of $^{131}$Ba, $^{131}$Cs, and $^{132}$Cs as a function of days of irradiation are shown in FIGS. 3-5, respectively. FIGS. 3-5 illustrate that from the start of irradiation, the liquid loop activities grow steadily such that the $^{131}$Ba reaches about 0.6 curies per mole of natural barium target after 30 days. The $^{131}$Cs level is about 0.4 curies at this time, and increases to about 0.6 curies after 55 days of operation. Thus, using the isotope production system 4 and process described above, a liquid loop target containing between 4 moles and 5 moles of natural barium is estimated to be able to produce several curies of recoverable $^{131}$Cs several times per month. The efficiency of the cesium/barium separation precludes the added neutron capture on $^{131}$Cs and minimizes $^{132}$Cs formation to acceptable levels in the recovered isotope product.

While the invention is susceptible to various modifications, as well as alternative forms and implementations, specific embodiments have been shown by way of example in the drawings and have been described in detail herein. However, the invention is not intended to be limited to the particular forms and embodiments disclosed. Rather, the invention, in various embodiments, is to cover all modifications, equivalents, and alternatives falling within the scope of the invention as defined by the following appended claims and their legal equivalents.

What is claimed is:

1. A method of producing cesium-131, comprising:

dissolving at least one non-irradiated barium source in water or a nitric acid solution to produce a barium target solution;

subjecting the barium target solution to neutron radiation to produce cesium-131; and removing the cesium-131 from the barium target solution.

2. The method of claim 1, wherein dissolving at least one non-irradiated barium source in water or a nitric acid solution comprises dissolving at least one nonirradiated barium compound selected from the group consisting of barium carbonate (BaCO3), barium chlorate (Ba(ClO3)2.H2O), barium chloride (BaCl2), barium formate (Ba(CHO2)2), barium fluoride (BaF2), barium nitrate (Ba(NO3)2), barium metal, and barium oxide (BaO) in the water or nitric acid solution.

3. The method of claim 1, wherein dissolving at least one non-irradiated barium compound in water or a nitric acid solution comprises dissolving at least one of a non-irradiated, natural barium compound and a non-irradiated, enriched barium compound in the water or nitric acid solution.

4. The method of claim 1, wherein dissolving at least one non-irradiated barium source in water or a nitric acid solution to produce a barium target solution comprises dissolving an amount of the at least one non-irradiated barium source in the water or nitric acid solution to provide a concentration of the at least one non-irradiated barium source of greater than or equal to approximately 0.5 M.

5. The method of claim 1, wherein dissolving at least one non-irradiated barium source in water or a nitric acid solution comprises dissolving an amount of the at least one non-irradiated barium source in the water or nitric acid solution to provide a concentration of the at least one non-irradiated barium source of from approximately 0.5 M to approximately 1 M.

6. The method of claim 1, wherein dissolving at least one non-irradiated barium source in water or a nitric acid solution comprises dissolving the at least one nonirradiated barium source in from approximately 1 M to approximately 3 M nitric acid.

7. The method of claim 1, wherein removing the cesium-131 from the barium target solution comprises flowing the barium target solution through a separation device comprising a calixarene compound.

8. A method of producing cesium-131, comprising:

irradiating a barium target solution comprising nitric acid and at least one non-irradiated barium-130 compound to produce cesium-131;

complexing the cesium-131 with a calixarene compound; and separating the cesium-131 from the irradiated barium target solution.

9. The method of claim 8, wherein irradiating a barium target solution comprising at least one non-irradiated barium-130 compound comprises irradiating the barium target solution comprising at least one naturally occurring barium-130 compound or at least one barium compound enriched in barium-130.

10. The method of claim 8, wherein separating the cesium-131 from the irradiated barium target solution comprises removing the cesium-131 by liquid-liquid extraction.

11. The method of claim 8, wherein separating the cesium-131 from the irradiated barium target solution comprises removing the cesium-131 by extraction chromatography.

12. A method of producing cesium-131, comprising:

irradiating a target solution comprising barium and nitric acid to produce an irradiated barium target solution;

enabling the irradiated barium target solution to decay for an amount of time sufficient to produce cesium-131; and continuously separating the cesium-131 from the irradiated barium target solution.

13. The method of claim 12, wherein irradiating a barium target solution to produce an irradiated barium target solution comprises exposing the barium target solution to neutron irradiation.

14. The method of claim 12, wherein continuously separating the cesium-131 from the irradiated barium target solution comprises continuously circulating the irradiated barium target solution through an isotope production system.

15. The method of claim 12, wherein continuously separating the cesium-131 from the irradiated barium target solution comprises continuously contacting the irradiated barium target solution with a calixarene extractant solution comprising at least one calixarene compound, at least one modifier, and a diluent.

16. The method of claim 12, wherein continuously separating the cesium-131 from the irradiated barium target solution comprises complexing the cesium-131 with a calixarene compound selected from the group consisting of: calix[4]arene-bis-(tert-octylbenzo)-crown-6, 1,3-alternate-25,27-di(octyloxy)calix[4]arenebenzocrown-6, 1,3-alternate-25,27-di(decyloxy)calix[4]arenebenzocrown-6, 1,3-alternate-25,27-di(dodecyloxy)calix[4]arenebenzocrown-6, 1,3-alternate-25,27-di(2-ethylhexyl-l-oxy)calix[4]arenebenzocrown-6, 1,3-alternate-25,27-di(3,7-dimethyloctyl-1-oxy)calix[4]arenebenzocrown-6, and 1,3-alternate-25,27-di(4-butyloctyl-l-oxy)calix[4]arenebenzocrown-6.

17. The method of claim 12, wherein continuously separating the cesium-131 from the irradiated barium target solution comprises continuously flowing the irradiated barium target solution through an extraction column comprising at least one calixarene compound supported on a solid support.

18. A method of producing cesium-131, comprising:

dissolving at least one non-irradiated barium source in nitric acid to produce a barium target solution;

irradiating the barium target solution in a nuclear reactor to produce cesium-131; and flowing the irradiated barium target solution through at least one separation device to remove the cesium-131.

19. The method of claim 18, further comprising continuously flowing the irradiated barium target solution through the nuclear reactor and the at least one separation device.

* * * * *